US009340033B2

(12) United States Patent
Frati

(10) Patent No.: US 9,340,033 B2
(45) **Date of Patent: *May 17, 2016**

(54) PROCESS FOR PRINTING WOOD-BASED FLAT ELEMENTS AND PRODUCTION LINE

(71) Applicant: Dante Frati, Dosolo (IT)

(72) Inventor: Dante Frati, Dosolo (IT)

( * ) Notice: Subject to any disclaimer, the term of this patent is extended or adjusted under 35 U.S.C. 154(b) by 0 days.

This patent is subject to a terminal disclaimer.

(21) Appl. No.: 13/668,544

(22) Filed: Nov. 5, 2012

(65) Prior Publication Data

US 2013/0057614 A1 Mar. 7, 2013

Related U.S. Application Data

(63) Continuation of application No. 11/713,277, filed on Mar. 1, 2007, now Pat. No. 8,328,303.

(30) Foreign Application Priority Data

Jun. 26, 2006 (IT) ..... MI2006A001227

(51) Int. Cl.
*B41J 11/00* (2006.01)
*B41J 2/21* (2006.01)
(Continued)

(52) U.S. Cl.
CPC ..... *B41J 2/2103* (2013.01); *B41J 3/407* (2013.01); *B41J 11/0015* (2013.01); *B41M 5/0047* (2013.01); *B41M 5/0076* (2013.01)

(58) Field of Classification Search
CPC ..... B41J 11/0015
USPC ..... 347/12, 13, 43, 5, 9, 19, 42, 14, 102; 118/46
See application file for complete search history.

(56) References Cited

U.S. PATENT DOCUMENTS 4,045,262 A 8/1977 Enzinger et al.
4,393,386 A 7/1983 Di Giulio
(Continued)

FOREIGN PATENT DOCUMENTS

DE 1201985 B 9/1965
DE 3219508 A1 12/1983
(Continued)

OTHER PUBLICATIONS

"CMYK color model", http://en/wikipedia.org/wiki/CMYK_color_model, internet publication. Admitted Prior Art.
(Continued)

*Primary Examiner* — Lam Nguyen
(74) *Attorney, Agent, or Firm* — Capitol City TechLaw

(57) ABSTRACT

A printing process for a wood-based flat element may involve a preliminary step of graphic composition using an electronic processor and relative software, and a printing step to print a surface of the wood-based flat element using an ink-jet printer of a single-pass type. The ink-jet printer may be controlled by the electronic processor. The ink-jet printer may be provided with print heads. For each color employed in the ink-jet printer, the number of print heads may be that required to cover the entire width of the surface to be printed. During the printing step, the wood-based flat element may be maintained at rest while the ink-jet printer performs a motion relative to the wood-based flat element to print the entire surface. The motion of the ink-jet printer may result in the wood-based flat element passing below the print heads, such that the entire surface of the wood-based flat element is printed in a single pass of the wood-based flat element below the print heads. Alternatively, during the printing step, the wood-based flat element and the ink-jet printer may perform a simultaneous motion relative to each other to print the entire surface. A production line for the manufacturing of a flat wood-based panel presenting a printed surface is also disclosed.

19 Claims, 5 Drawing Sheets

(51) Int. Cl.
*B41J 3/407* (2006.01)
*B41M 5/00* (2006.01)

(56) References Cited

U.S. PATENT DOCUMENTS

| | | | | |
|---|---|---|---|---|
| 4,849,768 | A | 7/1989 | Graham | |
| 5,198,054 | A | 3/1993 | Drake et al. | |
| 5,343,227 | A | 8/1994 | Hirosawa et al. | |
| 5,408,590 | A | 4/1995 | Dvorzsak | |
| 5,488,398 | A | 1/1996 | Matsubara et al. | |
| 5,572,244 | A | 11/1996 | Drake et al. | |
| 5,587,730 | A | 12/1996 | Karz | |
| 5,683,753 | A | 11/1997 | Yamaguchi et al. | |
| 5,689,296 | A | 11/1997 | Heitmann et al. | |
| 5,707,689 | A | 1/1998 | Hori | |
| 5,801,722 | A | 9/1998 | Ueda et al. | |
| 5,989,681 | A | 11/1999 | Martino | |
| 6,022,104 | A * | 2/2000 | Lin et al. | 347/102 |
| 6,213,461 | B1 | 4/2001 | Ratz et al. | |
| 6,286,920 | B1 | 9/2001 | Ridgway | |
| 6,312,099 | B1 | 11/2001 | Hawkins et al. | |
| 6,357,867 | B1 | 3/2002 | Hine | |
| 6,585,369 | B1 | 7/2003 | Sievert et al. | |
| 6,592,204 | B1 | 7/2003 | Beliveau et al. | |
| 6,634,729 | B1 | 10/2003 | Schuman et al. | |
| 6,684,787 | B1 | 2/2004 | Sauer | |
| 6,890,061 | B1 | 5/2005 | Freire et al. | |
| 7,104,216 | B2 * | 9/2006 | Suzuki et al. | 118/46 |
| 7,334,859 | B2 * | 2/2008 | Kojima | 347/19 |
| 8,111,409 | B2 | 2/2012 | Tabata et al. | |
| 2002/0061389 | A1 | 5/2002 | Brooker et al. | |
| 2003/0020767 | A1 | 1/2003 | Saksa | |
| 2003/0081265 | A1 | 5/2003 | Watanabe | |
| 2003/0207083 | A1 | 11/2003 | Hansson et al. | |
| 2003/0218663 | A1 | 11/2003 | Baxter et al. | |
| 2004/0026017 | A1 | 2/2004 | Taylor et al. | |
| 2004/0028830 | A1 | 2/2004 | Bauer | |
| 2004/0086678 | A1 | 5/2004 | Chen et al. | |
| 2005/0134617 | A1 * | 6/2005 | Yamaguchi et al. | 347/5 |
| 2005/0168502 | A1 | 8/2005 | Osumi et al. | |
| 2005/0185009 | A1 | 8/2005 | Claramunt et al. | |
| 2005/0200679 | A1 | 9/2005 | Falser et al. | |
| 2005/0212835 | A1 | 9/2005 | Konno | |
| 2005/0219292 | A1 | 10/2005 | Koike | |
| 2005/0275684 | A1 | 12/2005 | Yamaguchi et al. | |
| 2007/0001558 | A1 | 1/2007 | Fuller et al. | |
| 2007/0266877 | A1 | 11/2007 | Oldorff | |

FOREIGN PATENT DOCUMENTS

| | | | |
|---|---|---|---|
| DE | 4418663 | A1 | 11/1995 |
| DE | 19523363 | A1 | 11/1996 |
| DE | 10031030 | A1 | 1/2002 |
| DE | 10051088 | A1 | 4/2002 |
| DE | 69431424 | T2 | 4/2003 |
| DE | 20314522 | U1 | 2/2004 |
| DE | 10252863 | A1 | 5/2004 |
| DE | 202004000662 | U1 | 5/2004 |
| DE | 10318988 | A1 | 11/2004 |
| DE | 10323412 | A1 | 12/2004 |
| DE | 102004032058 | A1 | 5/2005 |
| DE | 20023641 | U1 | 6/2005 |
| DE | 102004002132 | A1 | 8/2005 |
| EP | 0389900 | A1 | 10/1990 |
| EP | 0761438 | A2 | 3/1997 |
| EP | 1038689 | A1 | 9/2000 |
| EP | 1354719 | A2 | 10/2003 |
| EP | 1364783 | A2 | 11/2003 |
| EP | 1798053 | A3 | 6/2007 |
| EP | 1839884 | A1 | 10/2007 |
| GB | 2212761 | A | 8/1989 |
| GB | 2343415 | A | 5/2000 |
| GB | 2419851 | A | 5/2006 |
| JP | 03-82501 | A | 4/1991 |
| JP | 6155729 | | 6/1994 |
| JP | 9323434 | | 12/1997 |
| JP | 2000190462 | | 7/2000 |
| JP | 2000334684 | | 12/2000 |
| JP | 2001220535 | | 8/2001 |
| JP | 2003225902 | | 8/2003 |
| JP | 2000-108066 | A | 4/2004 |
| JP | 2005238035 | A | 9/2005 |
| SU | 1574511 | A1 | 6/1990 |
| WO | 0058098 | A1 | 10/2000 |
| WO | 0058098 | A9 | 10/2000 |
| WO | 0058099 | A1 | 10/2000 |
| WO | 0063031 | A1 | 10/2000 |
| WO | 0148333 | A1 | 7/2001 |
| WO | 0200449 | A1 | 1/2002 |
| WO | 03084760 | A1 | 10/2003 |
| WO | 2004014649 | A1 | 2/2004 |
| WO | 2004042168 | A1 | 5/2004 |
| WO | 2004087435 | A1 | 10/2004 |
| WO | 2004096561 | A1 | 11/2004 |
| WO | 2005009735 | A1 | 2/2005 |
| WO | 2005051655 | A1 | 6/2005 |
| WO | 2005051661 | A1 | 6/2005 |
| WO | 2005/108095 | A2 | 11/2005 |
| WO | 2006002917 | A2 | 1/2006 |
| WO | 2006104497 | A1 | 10/2006 |

OTHER PUBLICATIONS

Helmut Teschner, "Offsetdrucktechnik", Fachschriftenverlag, 6 Auflage, 1989, pp. 726-732, Kapitel 16 "Physikalische Grundlagen fur die Drucktechnik", Abschnitte 16.5.8 "Licht und Farbe" und 16.5.9 "Subtraktive Farben: Korperfarben".

Deppe/Ernst, "MDF-Mitteldichte Faserplatten", DRW-Verlag, 1996, insbesondere Kapitel 6, Beschichten (von MDF), pp. 121-127.

Merriam-Webster online dictionary definition for the term "panel", http://merriam-webster.com/dictionary/panel, internet publication. Admitted Prior Art.

Merriam-Webster online dictionary definition for the term "element", http://merriam-webster.com/dictionary/element, Internet publication. Admitted Prior Art.

"The Printing Ink Manual", 2007, p. 62, Springer, Dordrecht, The Netherlands.

Preliminary Opinion by the EPO in an opposition proceeding related to counterpart European Patent No. EP 1 872 959, May 29, 2013.

Preliminary Opinion by the EPO in an opposition proceeding related to counterpart European Patent No. EP 2 080 630, Jun. 4, 2013.

Decision by the EPO in an opposition proceeding related to counterpart European patent No. EP 1 872 959, Dec. 13, 2013.

Decision by the EPO in an opposition proceeding related to counterpart European patent No. EP 2 080 630, Dec. 16, 2013.

Herausgegeben Von Den et al., "Der Brockhaus, Naturwissenschaft und Technik", 2003, p. 1998, printed in Germany.

Wikipedia online dictionary definition for the term "Grundierung", http://de.wikipedia.org/wiki/Grundierung. Admitted Prior Art.

Wikipedia online dictionary definition for the term "Primer", http://en.wikipedia.org/wiki/Primer_(paint). Admitted Prior Art.

* cited by examiner

PROCESS FOR PRINTING WOOD-BASED FLAT ELEMENTS AND PRODUCTION LINE

BACKGROUND

1. Field

The present invention relates to a process for printing surfaces of wood-based flat elements (for example wooden panels), of any type and size and originating from any production process, even if already semi-finished (for example previously subjected to surface incision, surface smoothing, cutting, sawing, drilling, chamfering, surface treatment with chemical agents or water-based agents, coating agents, adhesive agents or sealing agents, or panels covered with sheets of paper or plastic, or already subjected to squaring or edging).

2. Description of Related Art

In particular, the wood-based flat elements in the present context are those made from a mass of wooden particles (commonly known as chipboard panels which, as is well known to the expert of the art, can be of standard type, of E2, E1 or E0 type, of so-called isocyanate type or of fire-retardant or waterproof type; or again of low density or medium density wood fibre type (commonly known as MDF: medium density fibreboard); or high density (commonly known as HDF: high density fibreboard); or so-called wet fibre panels, or oriented wooden strand panels, commonly known as OSB (oriented strands board). All these wood-based flat elements normally have a thickness varying between 0.5 mm and 50 mm, a width between 50 mm and 3400 mm, and a length between 100 mm and 5600 mm or more.

As is well known to the expert of this sector, the aforesaid wood-based panels are obtained from wood-based flat products produced using double-belt continuous presses, or by so-called multi-compartment or single-compartment presses (commonly known as Mende presses).

To obtain a wood-based panel presenting a printed surface, three different processes are currently used, namely:

1. In a first process, the relevant surface of the wood-based panels is clad with a paper sheet carrying the most varied motifs, for example a motif representing a wood type, a type of stone or rock, photographs, written texts, fantasy motifs, or simply a surface of a single colour.

The paper sheets are of so-called base printing paper, possibly of preimpregnated type, or of overlay paper. The printed sheets are obtained by preprinting operations, which as is well known to the expert of the art are fairly complex and require considerable time, and in particular:

graphic composition, i.e. the graphic design and development;

form construction, or incision (by various methods) of one or more printing cylinders;

cylinder installation on a rotogravure or flexographic printing machine and their adjustment.

These preprinting operations together involve a downtime of the printing machine amounting to 6-8 hours, with the costs that this implies.

When printing has been carried out by said printing machine, the printed paper sheets obtained in this manner are applied to the wood-based panels. This is done by an impregnation operation (in which appropriate plants, known as impregnation plants, impregnate the printed sheets for example with thermosetting or vinyl adhesive agents, thermosetting urea or polyurethane resins). The impregnation operation is followed by a pressing operation by known hot pressing plants of various types, or by cold plants.

2. In a second known process the wood-based panels previously treated with sealants (such as fillers, lacquers or paper sheets) are printed directly. Also in this case preprinting operations are required, they being the same as for the first process, and as such are lengthy and costly. The wood-based panels are then directly printed.

3. The third known process is similar to the second, with the only difference that instead of a printing machine an ink-jet plotter is used, controlled by an electronic processor. As is well known, the panel to be printed is maintained at rest in the plotter, while the print heads (from one to four or more in number, one for each colour) move parallel to the surface to be printed. When the relative printing stage is complete, the panel advances through a distance equivalent to the width of the print head and the printing operation is repeated, and so on until the entire panel surface or that part thereof to be printed is complete.

As is well known to the expert of the sector, the printing process using a plotter is of low productivity (among the slowest of printing processes), and hence is unusable for large quantities. It also has a very high unit cost.

Again in this case preprinting operations are required, but comprise only graphic composition using suitable hardware supports and software obtainable commercially, plus a scanner.

In contrast to the first two, this third process using an ink-jet plotter enables surface which are not perfectly smooth to be printed.

SUMMARY

An object of the present invention is to provide a process for printing wood-based flat elements which involves decidedly lower costs and time than the aforedescribed known processes.

Another object of the invention is to provide a process of the aforesaid type which enables high productivity to be obtained with large production flexibility adaptable to specific client requirements.

These objects are attained by the process of the present invention, comprising a preliminary step of graphic composition by means of an electronic processor and relative software, and a printing step, characterised in that to print the wood-based flat elements an ink-jet printer is used controlled by the electronic processor, said flat element moving relative to the printer during the printing operation. This considerably reduces both the costs and production times compared with the aforedescribed known printing processes.

In the present case, the wood-based flat element can be moved by belt, roller or chain conveyor devices, or by conveyor devices using gripper means.

An ink-jet printer of dimensions and characteristics suitable for printing the surface of said wood-based flat elements is not commercially available, and in particular the printer must have several print heads for each required colour in order to cover the entire width of the surface to be printed. With regard to the colours, these can be as many as required to obtain the desired result, starting from a minimum of one (monochromatic colour). Preferably the three prime colours cyan, magenta and yellow are used, in addition to black.

Although it is convenient for the printed flat element to transit through the ink-jet printer while maintaining this fixed, in principle the present invention also covers the case in which the opposite takes place, i.e. the printed flat element is maintained at rest and the printer is moved relative thereto in order to print the entire surface thereof involved. The printing times are still substantially less than in the case of the known process using a plotter.

According to a further variant of the process of the present invention, to obtain particular print effects the flat element to be printed and the printer itself can be moved simultaneously, this latter always parallel to the surface of the flat element to be printed.

The process of the invention can conveniently comprise an additional step consisting of applying conventional coating or covering products to the printed surface of the flat element, to form a substantially transparent protective layer (possibly coloured) in order to give the printed surface greater resistance to the effects of light, stains, abrasion and scratching, or to give the printed surface the required finish. This can be obtained for example by passing the flat element, once printed, through conventional sprayers or coaters, or by using lamination heads or ink-jet heads, or by using conventional hot or cold roller applicators, or by applying to the printed surface substantially transparent protection sheets, possibly coloured, in particular of a suitable plastic and/or paper material.

To implement the process of the present invention, a single pass ink-jet printer is conveniently used, in which the print head nozzles propel ink micro-droplets of the required colour onto the surface to be printed, but do not themselves make contact with this surface, with the advantage that printing can be effected even if the surface to be printed is not perfectly smooth.

As will be immediately apparent, the process of the present invention enables wood-based flat elements to be printed in a decidedly lesser time than the aforedescribed processes of the known art, and enables any quantity, even very small (in the limit just one panel), to be produced at very low cost, and with the significant advantage of being able to drastically reduce, or even eliminate, the stock held in store.

As the printer used to implement the process is controlled by an electronic processor (normally a simple PC), different printed versions can be quickly created, to achieve personalized versions in accordance with specific client requirements.

The process of the present invention can be applied to different production lines, for example to a squaring line (for example for floor production), to a hot or cold pressing line for panel production, to a square edging line, to a framing line, or to a sectioning or drilling line.

It will be apparent to the expert of the art that after or before being printed, the wood-based flat elements can be subjected to all those operations and/or treatments to which the wood-based panels of known production processes are subjected.

BRIEF DESCRIPTION OF THE DRAWINGS

The process of the present invention will be more apparent from the ensuing description of some embodiments of a part of an apparatus comprising said ink-jet printer. In this description reference is made to the accompanying drawings, in which.

DESCRIPTION OF EXAMPLE, NON-LIMITING EMBODIMENTS

Figure 1:
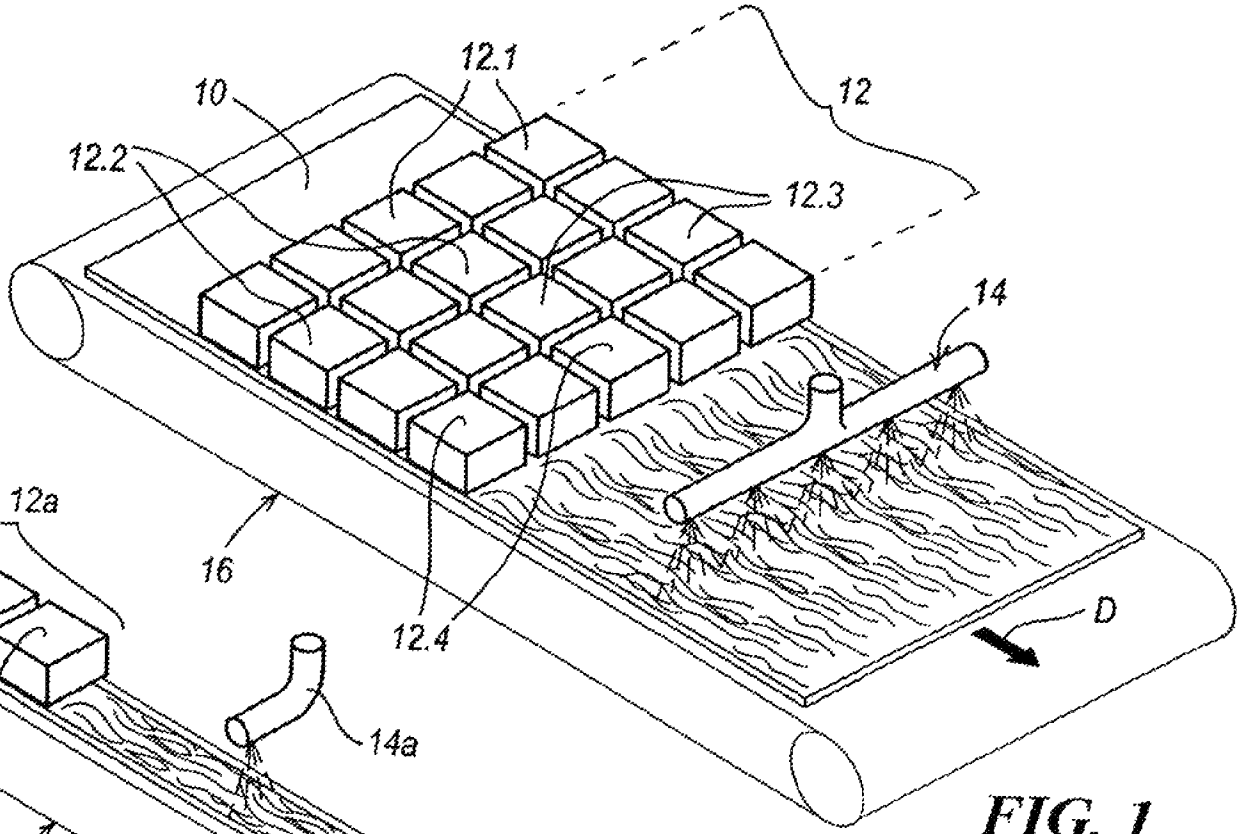
FIG. 1 is a schematic perspective view showing the print heads of the ink-jet printer used in the process according to the present invention, together with a belt drive device for driving a wood-based panel the upper surface of which is to be printed, and a device for spray-coating the printed surface with a protective layer.

With reference to FIG. 1, this shows a wood-based flat element 10 (for example a rectangular MDF panel) moved by a conveyor belt 16 in an advancement direction indicated by the arrow D in order to pass, in the illustrated embodiment, below four parallel rows of print heads indicated by 12.1, 12.2, 12.3 and 12.4 respectively. Each row of print heads relates to one colour, namely the three prime colours cyan, magenta and yellow, plus black. As can be seen from FIG. 1, each row of print heads is composed of five heads, and specifically a number of heads sufficient to cover the entire width of the rectangular panel 10. The heads 12.1-12.4 form part of an ink-jet printer (the rest of which is not shown for simplicity) indicated overall by 12 and in this specific case of the single pass type, in which the nozzles of the digital print heads propel ink microdroplets of the relative colour onto the surface to be printed (in this specific case the upper surface of the rectangular panel 10). The printer 12 is controlled by a conventional personal computer (not shown for simplicity) which operates via suitable commercially obtainable software. The definition (quantity of black or coloured dots per unit of surface) of the printer 12, measured in DPI (dots per inch), or number of pixels, is chosen on the basis of the required print quality. Hence a low definition may be deemed sufficient, or a medium, high or very high definition be necessary.

As in known processes, a preliminary graphic composition step (i.e. graphic design and development) is also required in the process of the invention, this being achieved by suitable commercially available hardware and software. In this specific case a scanner can be used (as in the known process using a plotter) which is able to separate the four base colours in the design or image to be reproduced on the panel surface. It will be easily apparent that designs or images of the most varied type can be reproduced on the panel surface, for example reproducing the appearance of a wood surface of a determined type, or that of a determined stone or rock, or even photographs, written texts or fantasy motifs. These images can be modified or compounded or broken down at will, to form relative graphic files from which a number of monochromatic images can be obtained. In its most simple variant, the printing operation can be reduced to simple coloration of the surface concerned, or just part of it, with a single colour.

Returning to FIG. 1, it can be seen that the upper surface of the panel 10 is printed (for example reproducing the appearance of a determined wood type) downstream of the printer 12. In the same figure it can be seen that downstream of the printer 12 a sprayer 14 is provided enabling the printed upper surface of the panel 10 to be coated with a conventional liquid substance providing a substantially transparent (possibly coloured) protective layer against the negative effects of light, or against staining, abrasion or scratching.

It should be noted that although in FIG. 1 the print heads 12.1-12.4 are positioned above the panel 10, alternatively they could be positioned below it (located in a region between two successive conveyor belts), or the panel could be moved while maintaining it vertical (using for example drive devices with grippers) with the print heads disposed on one or other side of the panel, or even on both its sides.

It should also be noted that instead of the belt drive device 16 of the figures (which can also be of suction type), other drive devices can be used, for example of roller type, of chain type (with or without prongs) or provided with said gripper means.

Figure 1A:
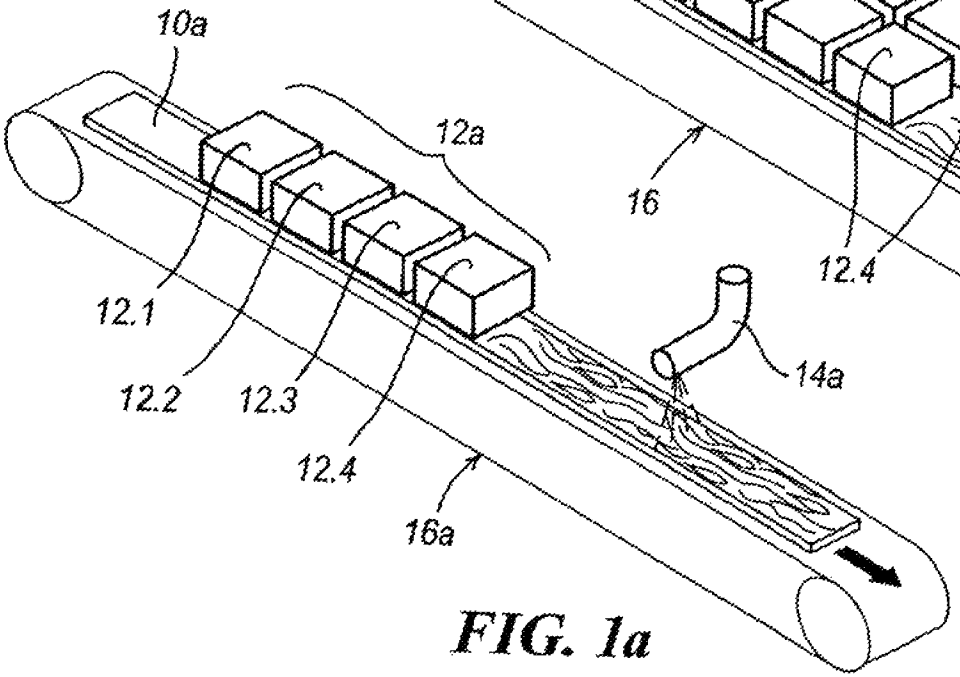
FIG. 1*a* is a variant thereof in the case of a very narrow panel.
Figure 2:
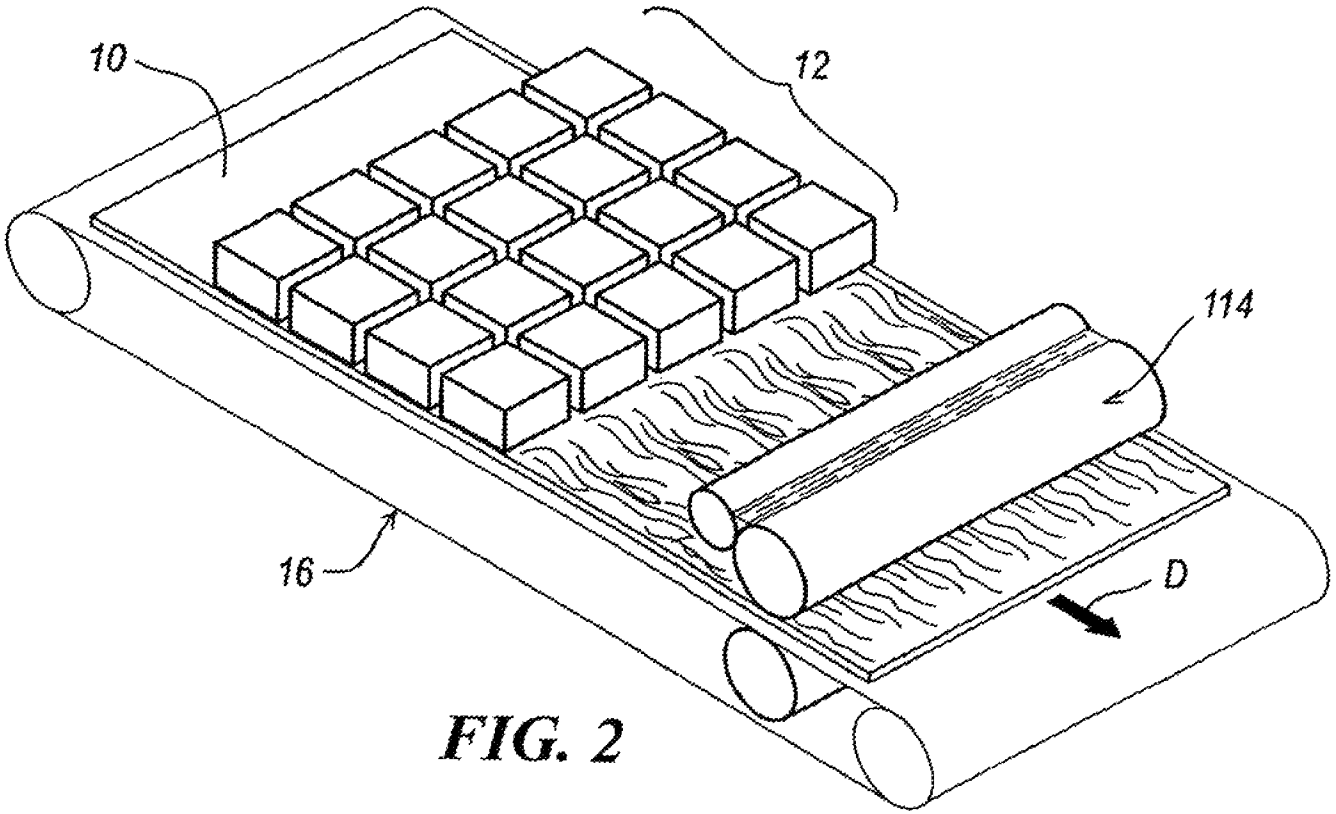
FIG. 2 is similar to FIG. 1, but with the difference that the device for applying the protective layer is of the roller applicator type.
Figure 3:
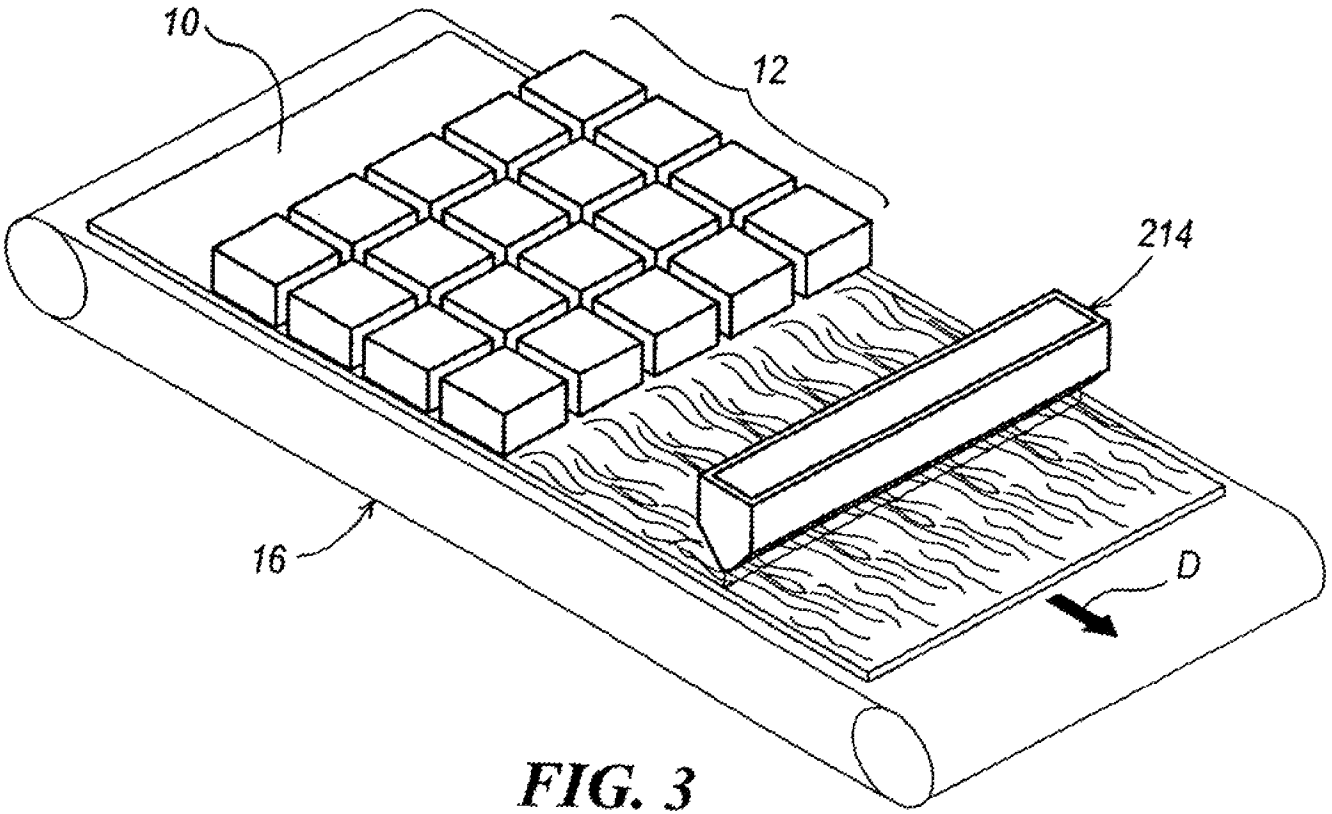
FIG. 3 is similar to FIG. 1, but with the difference that the device for applying the protective layer is of the coater type.
Figure 4:
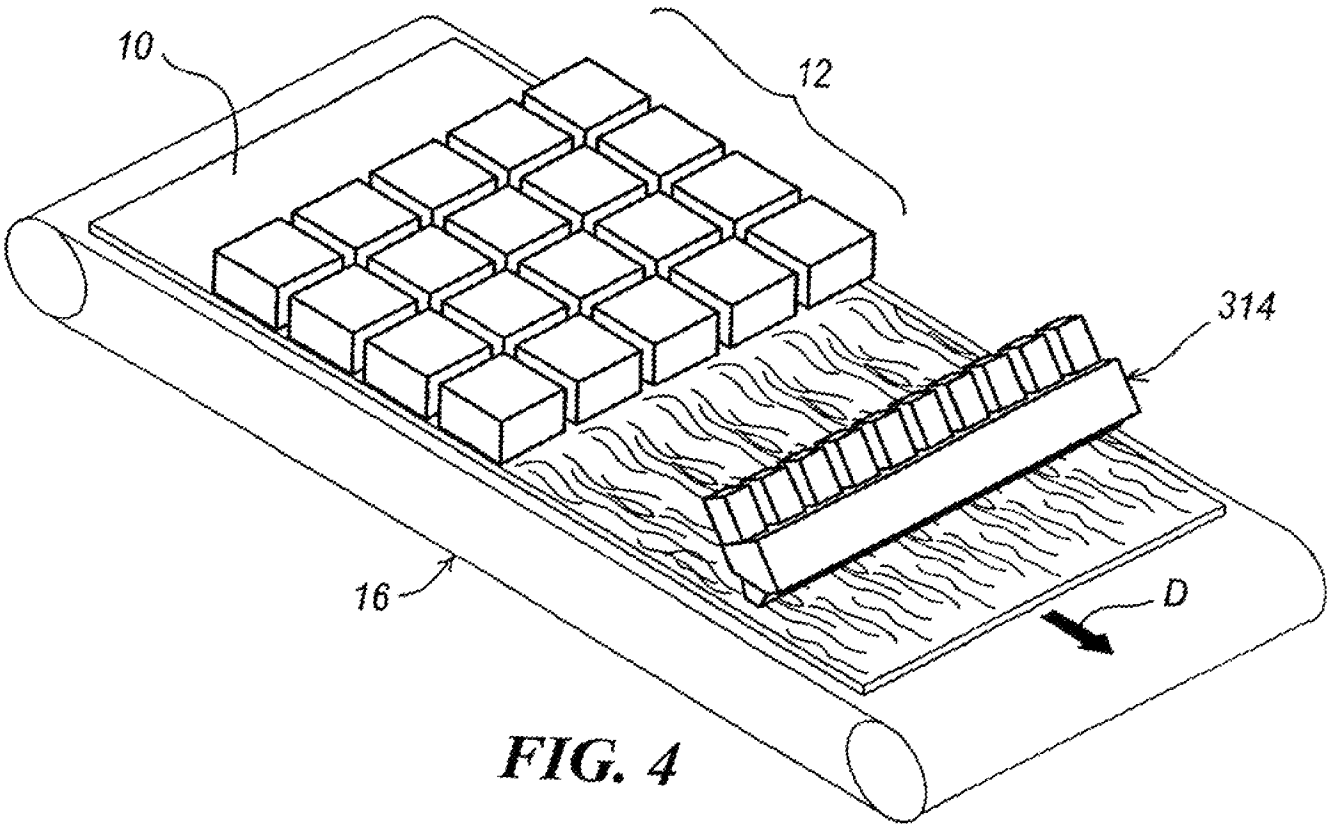
FIG. 4 is similar to FIG. 1, but with the difference that the device for applying the protective layer is of the laminating head type.
Figure 5:
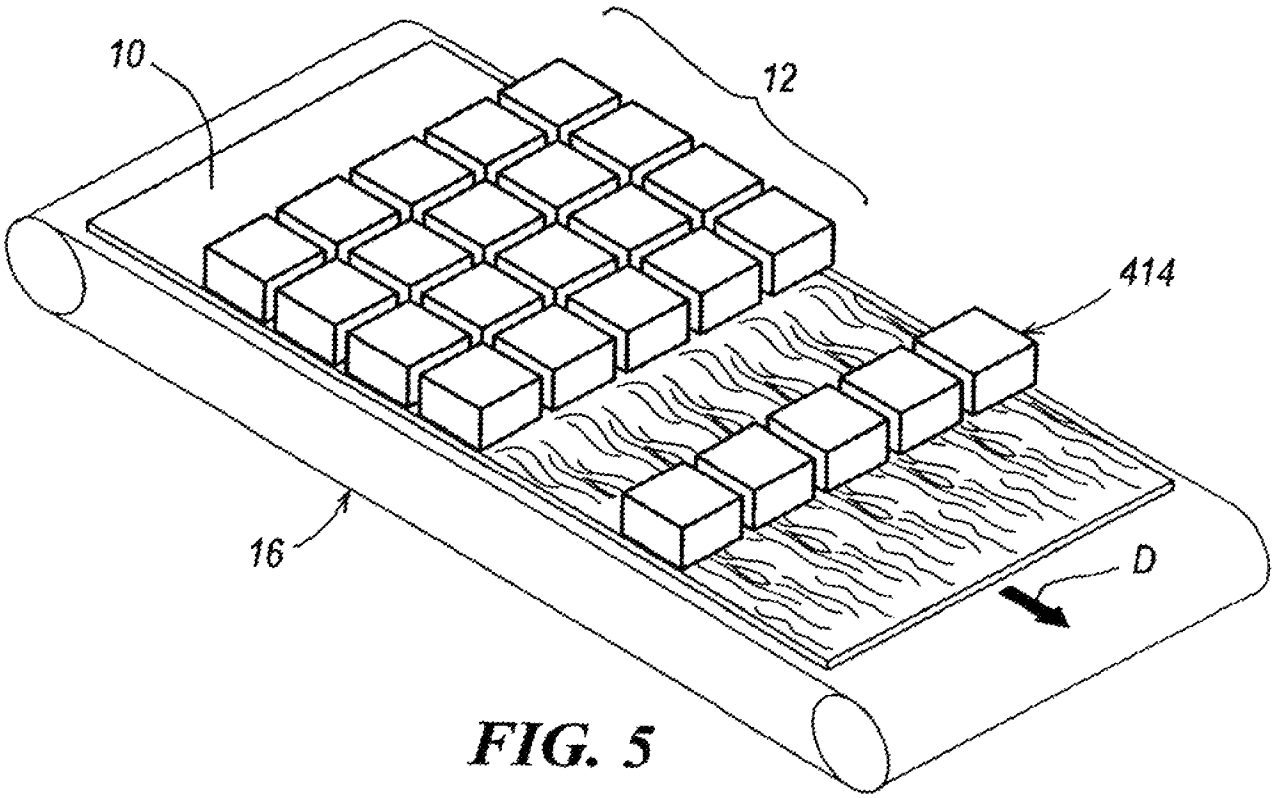
FIG. 5 is similar to FIG. 1, but with the difference that the device for applying the protective layer is of the ink-jet printer type.

If the production line is dedicated to the printing of very narrow panels, such as the panel 10*a* of FIG. 1*a*, it can be sufficient to provide a single print head 12.1-12.4 for each colour. In that case the spray device, indicated by 14*a*, is simplified.

FIGS. 2-5 (in which the same reference numerals as FIG. 1 are used for equal parts) differ from this latter figure only by the provision of a different device for applying the protective liquid substance. Specifically, in FIG. 2 a roller applicator 114 is used, in FIG. 3 a coater 21 is used, in FIG. 4 a lamination head 314 and in FIG. 5 a print head of ink-jet type 414.

As will be apparent from the aforegoing, the process of the present invention allows maximum flexibility and production versatility, together with high productivity at low cost, all because of the use of the ink-jet printer. If this latter is of the type in which the nozzles of the print heads do not make contact with the surface to be printed, panels with non-smooth surfaces can also be printed.

What is claimed is:

1. A process for printing a wood-based flat element, comprising:

a preliminary step of graphic composition using an electronic processor and relative software; and a printing step to print a surface of the wood-based flat element using an ink-jet printer of a single-pass type, the ink-jet printer being controlled by the electronic processor;

wherein the ink-jet printer is provided with a number of print heads;

wherein for each color employed in the ink-jet printer, the number of print heads is that required to cover the entire width of the surface to be printed;

wherein during the entire printing step, the wood-based flat element is maintained at rest and the ink-jet printer performs a motion relative to the wood-based flat element to print the entire surface;

wherein the motion of the ink-jet printer results in the wood-based flat element passing below the print heads, such that the entire surface of the wood-based flat element is printed in a single pass of the wood-based flat element below the print heads;

wherein during the motion of the ink-jet printer relative to the wood-based flat element, at least one of the print heads propels ink onto the wood-based flat element;

wherein prior to the printing step, the process includes treating with a sealant that surface of the wood-based flat element to be printed; and wherein the process further includes a step of applying a substantially transparent protection sheet using a hot applicator to the printed surface of the wood-based flat element, the protection sheet including a paper material.

2. The process as claimed in claim 1, wherein during the printing step, the entire surface is provided with a multi-colored image.

3. The process as claimed in claim 2, wherein the colors employed in the ink-jet printer are the prime colors cyan, magenta, and yellow in addition to black.

4. The process as claimed in claim 2, wherein for each color a single print head covers the entire width of the surface to be printed.

5. The process as claimed in claim 2, wherein for each color a plurality of print heads are arranged in a row to cover the entire width of the surface to be printed.

6. The process as claimed in claim 1, wherein the wood-based flat element is made from a mass of wooden particles; and wherein the wood-based flat element is one of a chipboard panel, a panel of the low density fiber type, a medium density fiberboard, a high density fiberboard, a wet fiber panels and an oriented wooden strand panels.

7. A process for printing a wood-based flat element, comprising:

a preliminary step of graphic composition using an electronic processor and relative software; and a printing step to print a surface of the wood-based flat element using an ink-jet printer of a single-pass type, the ink-jet printer being controlled by the electronic processor;

wherein the ink-jet printer is provided with a number of print heads;

wherein for each color employed in the ink-jet printer, the number of print heads is that required to cover the entire width of the surface to be printed;

wherein during the printing step, the wood-based flat element and the ink-jet printer perform a simultaneous motion relative to each other to print the entire surface;

wherein the simultaneous motion results in the wood-based flat element passing below the print heads, such that the entire surface of the wood-based flat element is printed in a single pass of the wood-based flat element below the print heads;

wherein during the simultaneous motion of the wood-based flat element and the ink-jet printer relative to each other, at least one of the print heads propels ink onto the wood-based flat element;

wherein prior to the printing step, the process includes treating with a sealant that surface of the wood-based flat element to be printed; and wherein the process further includes a step of applying a substantially transparent protection sheet using a hot applicator to the printed surface of the wood-based flat element, the protection sheet including a paper material.

8. The process as claimed in claim 7, wherein during the printing step, the entire surface is provided with a multi-colored image.

9. The process as claimed in claim 8, wherein the colors employed in the ink-jet printer are the prime colors cyan, magenta, and yellow in addition to black.

10. The process as claimed in claim 8, wherein for each color a single print head covers the entire width of the surface to be printed.

11. The process as claimed in claim 8, wherein for each color a plurality of print heads are arranged in a row to cover the entire width of the surface to be printed.

12. The process as claimed in claim 7, wherein the wood-based flat element is made from a mass of wooden particles; and wherein the wood-based flat element is one of a chipboard panel, a panel of the low density fiber type, a medium density fiberboard, a high density fiberboard, a wet fiber panels and an oriented wooden strand panels.

13. A production line for the manufacturing of a flat wood-based panel presenting a printed surface, the production line comprising:

an ink-jet printer of a single-pass type; and an electronic processor to control the ink-jet printer;

wherein the ink-jet printer includes print heads configured to print an entire surface of the wood-based panel, each print head relates to only one color chosen from the group of cyan, magenta, yellow and black, and the print heads are arranged in rows, with each row relating to only one color;

wherein each row includes a number of print heads sufficient to cover the entire width of the surface to be printed;

wherein the ink-jet printer is configured to perform a relative motion to the wood-based panel during a printing operation;

wherein the relative motion of the ink-jet printer results in the wood-based panel passing below the print heads, such that the entire surface of the wood-based panel is printed in a single pass of the wood-based panel below the print heads;

wherein during the motion of the ink-jet printer relative to the wood-based panel, at least one of the print heads propels ink onto the wood-based panel;

wherein the production line further comprises a hot applicator for applying a substantially transparent protection sheet to the printed surface of the wood-based panel, the protection sheet including a paper material; and wherein the hot applicator is a hot press.

14. The production line according to claim 13, wherein a single print head is provided for each color.

15. The production line according to claim 13, wherein the electronic processor allows choosing a definition of the ink-jet printer.

16. The production line according to claim 13, wherein the ink-jet printer includes print heads with nozzles that do not make contact with the surface to be printed.

17. The production line according to claim 13, wherein the production line is a floor production line that comprises at least one of a squaring line, a square edging line, a framing line, a hot or cold pressing line, a sectioning line and a drilling line.

18. The production line according to claim 13, wherein, during the relative motion of the ink-jet printer, the wood-based panel is maintained at rest.

19. The production line according to claim 13, wherein, during the relative motion of the ink-jet printer, the wood-based panel moves.

* * * * *